US006042251A

United States Patent [19]

McCarthy et al.

[11] Patent Number: 6,042,251

[45] Date of Patent: Mar. 28, 2000

[54] MULTI-CONFIGURED LIGHTING FIXTURE FOR SURFACE MOUNTING

[75] Inventors: Charles A. McCarthy, Lake in the Hills; Gabriel Pasko, Round Lake Beach, both of Ill.

[73] Assignee: Kenall Manufacturing Co., Gurnee, Ill.

[21] Appl. No.: 08/858,214

[22] Filed: May 10, 1997

[51] Int. Cl.[7] ..... F12V 5/00; F12V 15/00

[52] U.S. Cl. ..... 362/308; 362/307; 362/329; 362/374; 362/375; 362/359; 362/328; 362/319; 362/322; 362/147

[58] Field of Search ..... 362/307, 308, 362/327, 328, 329, 374, 375, 351, 359, 277, 279, 319, 322, 325, 290, 291, 292

[56] References Cited

U.S. PATENT DOCUMENTS

| | | | |
|---|---|---|---|
| 4,462,068 | 7/1984 | Shadwich | 362/332 |
| 4,519,018 | 5/1985 | Rowland | 362/280 |
| 5,313,379 | 5/1994 | Lemons et al. | 362/298 |
| 5,560,707 | 10/1996 | Neer | 362/376 |
| 5,681,104 | 10/1997 | Chinniah et al. | 362/297 |

*Primary Examiner*—Thomas M. Sember
*Attorney, Agent, or Firm*—Michael G. Berkman

[57] ABSTRACT

There is described a multi-configurational, multi-functional electrical lighting fixture for high-abuse application and structured for surface mounting. The fixture includes a lens of U.V. stabilized, high impact-resistant, injection molded polycarbonate plastics, integrally formed with two selective, separate and distinct, high-performance reflector/refractor surface systems carried by the single lens, as separate zonal areas. The first system generates a long and narrow "throw", and the second system a short and wide "throw". A molded, opaque "eyelid" provides optimum lamp shielding and controls light distribution. The lens surmounts a lens base to which it is secured by means of unique internal, integrally-molded lugs received in cooperating hook-shaped slots. An 0-ring gasket establishes a water-tight seal. Unlocking of the assembly is deterred by means of a single, tamper-resistant screw. The lens base is mounted on a deep casting, with or without an interposed cast aluminum baseplate. Alternatively, the lens base may be mounted directly on the cast aluminum baseplate, without the deep casting, to provide a low-profile fixture structure.

23 Claims, 7 Drawing Sheets

MULTI-CONFIGURED LIGHTING FIXTURE FOR SURFACE MOUNTING

FIELD AND BACKGROUND OF THE INVENTION

The present invention relates to an electrical lighting fixture. More particularly, the invention is directed to a multi-configured electrical fixture for high-abuse lighting, and adapted for surface mounting.

The fixture of the invention is especially useful in applications where one desires to be able to exercise options, for example, to install a fixture housing having a low profile, or, alternatively, to provide a deeper housing when higher energy input is desired so as to provide increased illumination.

In accordance with the practice of the present invention, one is enabled quickly and easily to modify or to "adapt" the fixture by incorporating an auxiliary fixture component. The latter constitutes a substantially larger housing in the form of a relatively deep, dish-like metal casting. The addition of the deeper, energy-dissipating housing is effected without the need to remove the original baseplate which constitutes the floor-like base or closure of the low-contour embodiment of the fixture.

Alternatively, the original, die-cast aluminum baseplate of the fixture may be removed and set aside, and the lens-carrying lens base of the fixture may then be fastened directly onto the die-cast aluminum, dish-like "deep casting". The latter has its own, integrally-formed surface adapter or floor.

The versatility of the surface-mounted fixture of the present invention is further augmented and enhanced by providing, in the same basic fixture, two distinct and separate, selectively-operable, high-performance reflector/refractor systems. The first system generates a long and narrow "throw" or light distribution pattern. In a preferred embodiment of the invention, this is accomplished by means of a formed parabolic reflector used in conjunction with a refractor incorporating an array of parallel vertical flute prisms. The second system generates a short and wide "throw" through the employment of a multi-faceted reflector system used in conjunction with a refractor incorporating a tight band of sharp, vertical prisms.

The selection of either of the above-identified modes of "throw" or light distribution patterns is effected through use of a lens which carries two distinct and separate, selectible refractory patterns or integrally-formed physical "impressions".

Selection of the operational mode desired is effected by rotationally positioning an "eyelid" carried on the fixture and overlying an areal section of the lens. The rotatably-positionable eyelid includes a diameter which defines, identifies or demarks two separate and distinct generally hemispherical zonal areal sectors. It will be appreciated that the lens of the fixture may be other than round. For example, the lense may be ellipsoid.

To select a desired mode of operation (the "throw" of the fixture), it is necessary merely to rotate the eyelid to expose that sector through which the light beam is to pass. The light beams emanating from the fixture would, for example, then take the form of either a "long and narrow" pattern or "throw", or a "short and wide" throw, or distribution pattern of illumination.

It will be appreciated that the several components of the lighting fixture of the invention may be employed in a series of different mechanical arrangements, each of which has its own and separate utility for accommodating and effectuating different operational demands or requirements. In its most simple mechanical format, the fixture includes a die-cast aluminum baseplate surmounted by a lens base of molded polycarbonate which, in turn, carries the lens of the fixture.

In a second embodiment of the invention, the die-cast aluminum baseplate is mounted on a deep, dish-like aluminum casting which is integrally formed with its own surface adapter.

In a third embodiment of the fixture of the invention, the die-cast aluminum baseplate is not utilized, and the polycarbonate lens base is surmounted directly on the dish-like deep aluminum casting.

As indicated above, it is a principal object and aim of the invention to provide an architectural lighting fixture for high-abuse areas and which, with simple arrangement and rearrangement of component elements provides a high degree of versatility to accommodate differing requirements in voltage as well as different patterns of light distribution to satisfy different uses and needs.

As conceived and reduced to practice, the present invention obviates many of the shortcomings and inadequacies exhibited in prior art surface-mounted lighting fixtures of the general class herein described.

SUMMARY OF THE INVENTION

It is an important feature of the present invention that it provides a lighting fixture which is readily adaptable to assume any of a group of physically distinct configurations, each of which has a specific, special utility.

A related advantage of the lighting fixture of the invention is that each of the several physical configurations is readily and simply achievable by either the "insertion" or removal of particular structural elements, all manually, and without the used of tools.

Yet another feature contributing to the versatility of the lighting fixture of the invention is that it includes simple means by which the pattern of light distribution may be varied and directed.

A general feature of the lighting fixture of the invention is that it may be mounted on either a ceiling or on a wall. The fixture of the invention is characterized by a high resistance to physical abuse.

A feature of some embodiments of the fixture of the invention is a baseplate fabricated of die-cast aluminum provided with cast-in screw bosses and formed with minimal openings susceptible to moisture and to dust penetration.

An important feature of the baseplate of the fixture is that it constitutes an integral ballast heat sink.

In a preferred embodiment of the invention the baseplate is provided with a urethane powder coat finish, rendering it essentially inert to environmental chemical hazards.

Yet another convenient feature of the baseplate is that it is provided with four-point mounting and junction box breakouts.

A related feature of the baseplate is that it is formed with a circumambient annular groove or channel for accommodating closed cell gaskets or O-rings of Neoprene or Silicone.

A feature of the present invention is that the baseplate of the fixture is formulated, designed and engineered to accommodate the most efficient and innovative ballasts currently manufactured in the United States.

The lamp and reflector system embodied in the fixture of the invention utilizes high lumen, cold weather compact fluorescent lamps, the lamps and the ballasts being positioned well away from impact zones.

It is a related feature of the invention that the lamp sockets are vibration absorbing.

Yet another feature of the fixture of the invention is that the lamps are effectively shielded from viewing angles.

In a preferred embodiment of the invention the finish constitutes a urethane white powder coat providing 90% reflectivity.

It is an important feature of the lighting fixture of the invention that it includes a lens base fabricated of high impact and U.V.resistant injection molded polycarbonate, and is held to ensure close tolerance mating of the lens base and the baseplate channel.

An exceedingly important structural feature of the fixture of the invention is that the lens of the fixture surmounts a lens base to which it is secured by means of a unique, internal array of integrally-molded, annularly-spaced lugs received in cooperating generally hook-shaped slots.

Yet another, related feature of the invention is the provision of an O-ring gasket for establishing a fluid-impervious seal between the mating components.

A related feature is that the O-ring consists of a closed cell, Silicone O-ring gasket frictionally positioned in a co-extensive channel of the baseplate.

An exceedingly important feature of the lighting fixture of the invention is its lens of U.V. stabilized, high-impact-resistant, virgin, injection-molded polycarbonate.

In a preferred embodiment of the invention the lens is fabricated to effectuate two distinct and separate reflector/refractor systems, including a first system generating a long and narrow "throw" or light distribution, and a second system which generates a short and wide "throw".

An important feature of the invention, contributing to the diverse utility thereof, is the provision of an aluminum deep casting on which the die-cast aluminum baseplate of the fixture may be mounted, as an optional mode of assembly of the fixture. The polycarbonate lens base is, in turn, mounted on and secured to the aluminum baseplate.

A related feature of the invention is that the deep aluminum casting is integrally formed with a plurality of upstanding piers or bosses for supporting the overlying die cast aluminum baseplate and the polycarbonate lens base which are secured in place by means of threaded bolts.

In the specific embodiment of the invention illustrated, the polycarbonate lens base is integrally formed with interior, depending legs which bear upon and are secured to the underlying die cast aluminum baseplate by means of threaded bolts.

It is an important feature of the invention that the fixture may be assembled as a combination of the polycarbonate lens base secured directly to the supporting deep aluminum casting, without the use of any intermediate or interposed die-cast aluminum baseplate.

In a still more abbreviated embodiment of the fixture of the invention, the aluminum deep casting may be dispensed with and the lens-supporting polycarbonate lens base may be fastened directly onto the die-cast aluminum baseplate. The latter is secured, in turn, to a supporting ceiling or wall structure.

In accordance with the practice of the present invention, a single lens is used in achieving, selectively, either the long and narrow "throw", or the short and wide "throw".

In a preferred embodiment of the invention, the spherical, light-transmitting areal surface of the lens is divided, along a diameter, into two distinct sectors. The first sector is formed with parallel vertical flute prisms which, in conjunction with a parabolic reflector of the lamp and reflector system of the invention, provide a long "throw". The second sector is formed with a refractor constituting a tight band of sharp vertical prisms. These, in conjunction with a multi-faceted reflector system of the invention, provide the short and wide "throw", in accordance with the practice of the invention.

In a preferred embodiment of the invention, one set of refractors consists of evenly spaced Blondel flutes (0.75 inch radius) on a spherical surface. The other refractor consists of evenly-spaced pyramidically-shaped prisms, being 60 degree prisms, for example.

It is a feature of the present invention, contributing to the versatility and the general adaptability of the fixtures of the invention, that the lens configuration may be any of a plurality of contours or "shapes", including not only round, but also ellipsoid or oval. Additionally, the "depth" of the lens itself may vary within a substantial range of practical and aesthetic limits.

It is a feature of the invention that in the case of embodiments using oval or ellipsoid shaped lenses, the surface area may be halved along either a major or a minor axis of the oval structure.

In some embodiments of the lighting fixture of the invention the lens surface may be contoured to provide illumination in the form of a high efficiency starburst, achieved in both a clear prismatic lens as well as in a high efficiency pearlescent finish.

In a preferred embodiment of the invention equal brightness Blondel flutes are provided to obscure lamp images, thus providing equal brightness at all viewing angles.

It is an important feature of the fixtures of the present invention that the lens is held to very close tolerances to ensure contiguous mating of the lens within the lens base channel.

In preferred embodiments of the present invention a closed-cell, Silicone "O" ring gasket is frictionally secured and retained in a lens base gasket channel.

It is an important feature of the present invention that there is provided an eyelid to shield a portion of the light generated in the lighting fixture.

In a preferred embodiment of the invention the eyelid effectively covers essentially one half of the areal expanse of the lens of the fixture.

In the illustrated embodiment of the invention the eyelid consists of an individually molded, opaque component designed to provide optimal lamp shielding and light distribution, and to ensure backlight for aesthetically pleasing contrast, and for wall illumination.

It is an important feature of the invention that there are provided close tolerances in the fabrication of the eyelid component, ensuring reliable and effective push/turn/lock-in-place mating of the eyelid lens and lens base secured with a single, concealed POSIGRIP fastener or tamper-resistant screw.

Other and further objects, features and advantages of the invention will be evident from a reading of the following description considered in conjunction with the drawings.

DESCRIPTION OF ILLUSTRATED EMBODIMENT

Figure 1:
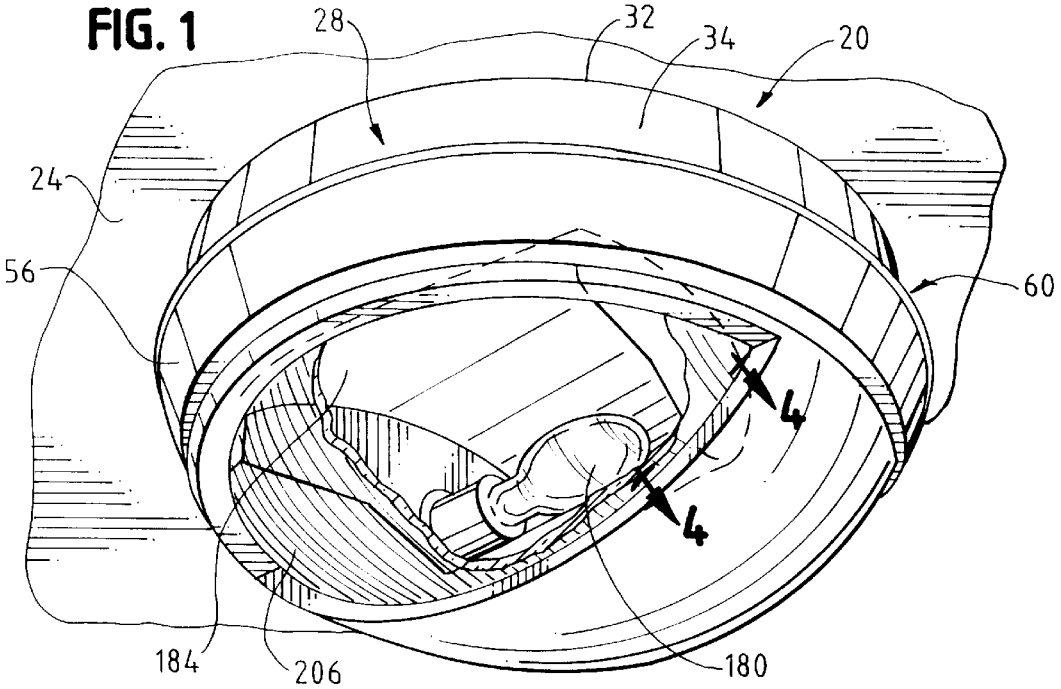
FIG. 1 is a perspective view showing a surface-mounted lighting fixture according to the invention, and secured to a ceiling, a part of the lens having been cut away for visual clarity.

The aims and objects of the present invention are accomplished, in part, by providing in a lighting fixture, a family of structural components which may be used in various combinations, selectively, to provide a group of differing fixture structures or "designs", each adapted to meet and satisfy different practical applications and uses.

The multi-configurational, multi-functional electrical lighting fixture of the invention, which is especially engineered and constructed for high abuse areas and applications, is conveniently adapted for surface mounting, as on walls or ceilings. The fixture includes a lens of U.V. stabilized, high-impact-resistant, injection-molded polycarbonate plastics, integrally formed with two selective, separate and distinct, high-performance reflector/refractor surface systems carried by a single lens, as separate zonal areas. The first system generates a long and relatively narrow throw or light distribution pattern, and the second system, a short and wide throw.

In certain preferred embodiments of the invention, there is provided a molded, opaque "eyelid" which is secured to and overlies the lens of the lighting fixture. The eyelid defines that areal expanse of the lens through which light is transmitted, provides optimum lamp shielding, and controls light distribution. In other applications of the invention, a completely "exposed" or unobstructed lens may be used. The lens itself surmounts a lens base—also of a molded, high strength plastics composition—to which the lens is secured by means of a unique design and fabrication of internal or interior, integrally-molded lugs or ledge-like tabs or protusions which are matingly received in cooperating inwardly opening slots or keyways formed in the lens base. Through a slight relative rotation, after aligning the lens and the lens base, the two components are interlocked and drawn toward one another in positive, stressed interengagment. In a preferred embodiment of the invention, an interposed O-ring or gasket of silicone, or the like, is employed to establish a fluid-impervious seal between the two components. As an additional securement feature, a single, tamper-resistant screw is used to deter unlocking of the assembly. The lens base is, in turn, mounted on a deep metal casting, either with or without an interposed die-cast aluminum baseplate. Alternatively, the lens base may be mounted directly on the cast aluminum baseplate, with the deep casting omitted, thereby providing a fixture having a low-profile structural configuration.

Referring now to the drawings, there are shown several preferred embodiments of the lighting fixture of the invention, provided for illustrative purposes, and not to be construed in any limiting sense.

Figure 2:
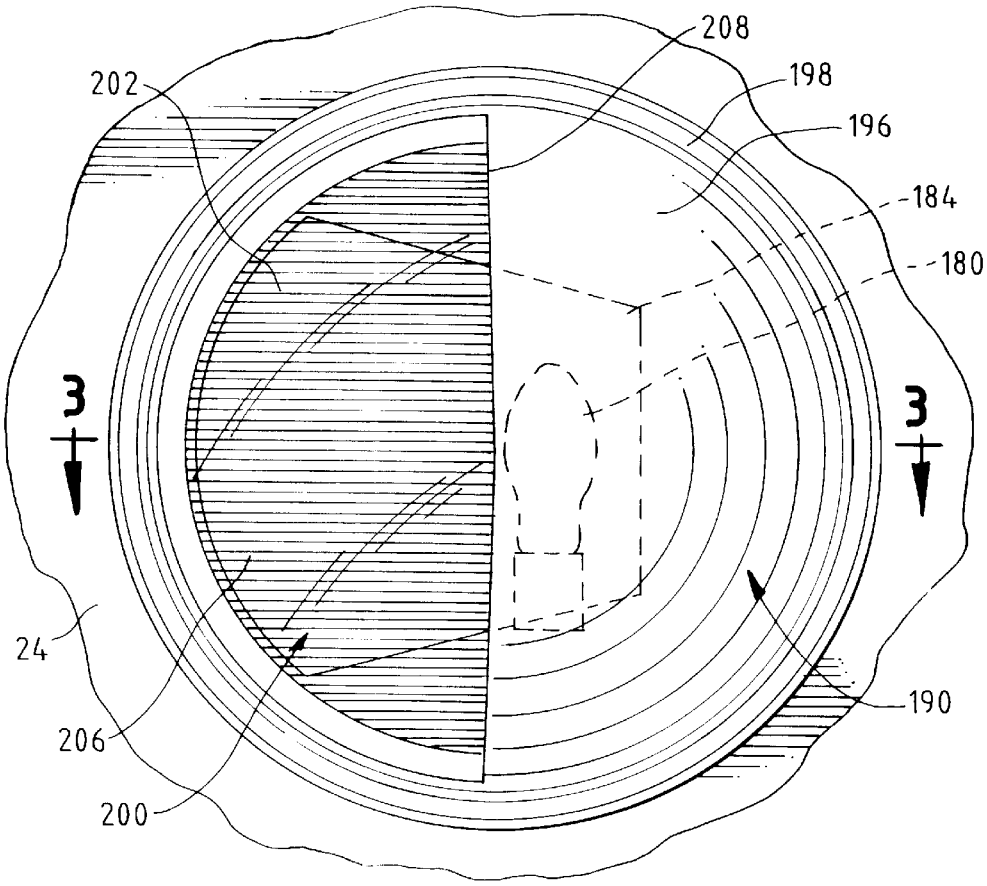
FIG. 2 is an elevational view of the fixture of FIG. 1, as seen looking up at the ceiling.
Figure 3:
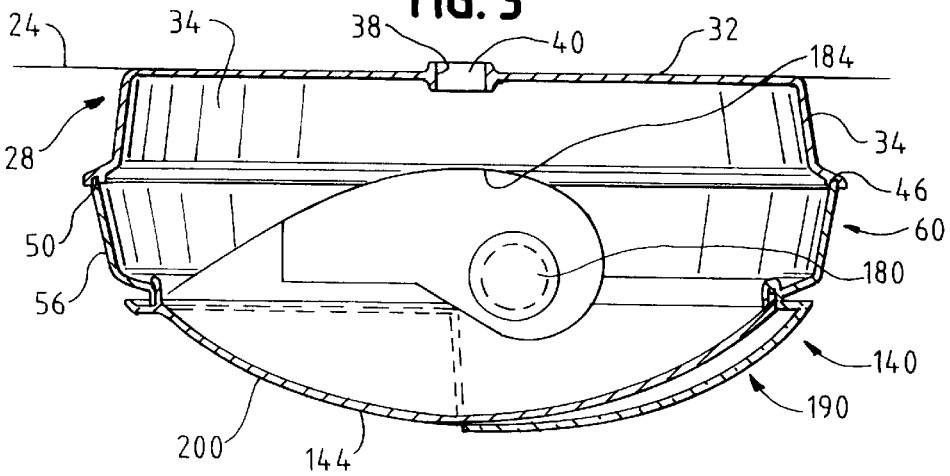
FIG. 3 is a cross-sectional view taken substantially on the lines 3—3 of FIG. 2, and showing the parabolic reflector of the fixture.
Figure 9:
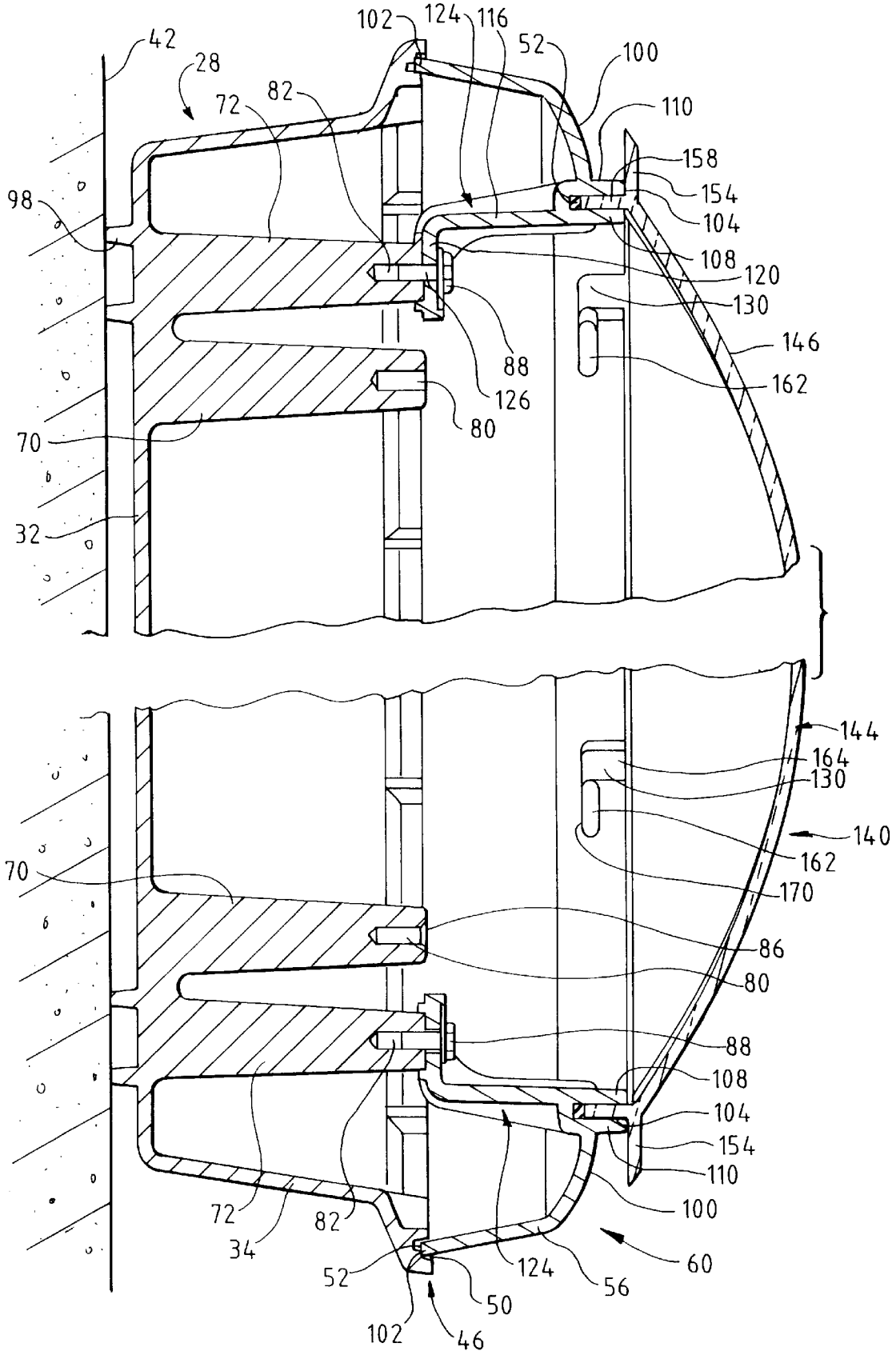
FIG. 9 is a vertical cross-sectional view of one embodiment of a lighting fixture in accordance with the present invention, and showing the lens base supported on snd secured to piers of a deep metal casting, and also showing the lens base sealed to and supporting the lens.

Directing attention first to FIGS. 1 through 4, the lighting fixture 20 illustrated is an embodiment of the type secured to a ceiling 24. As shown, the fixture 20 includes several distinct principal components. The first constitutes a base or housing 28 shown in an inverted mode in FIGS. 1 and 3, in which the fixture 20 is ceiling mounted. In FIG. 9, the fixture 20 is wall mounted. The same base 28 is used in each of the several embodiments of the invention in which it constitutes a component. Fabricated of cast aluminum, the housing 28 is generally dish-shaped and is relatively deep, consisting of a round, generally flat floor or bottom member 32 and an integrally-formed, upwardly-extending circular sidewall 34, which flares upwardly and slightly outwardly. As best seen in FIG. 3 the floor 32 is formed with a threaded 38 through port or hole 40 for accommodating an electrical conduit fitting (not shown). FIGS. 1 and 3 show the "floor" 32 of the housing 28 secured to an overhead support or ceiling 24. In FIG. 9 the fixture 20 is shown as mounted on a wall 42.

At its upper, open end of the housing 28, the encircling sidewall 34 is integrally formed with an outwardly-directed, flange-like, circumambient lip or ledge 46. The lip 46 is formed with an upwardly-opening, channel-like, annular groove 50 (FIG. 9) for accommodating a gasket 52 of a silicone composition, or the like, to provide a fluid-impervious seal between the housing 28 and a circumambient wall 56 of a lens base 60 of the fixture 20 bearing thereupon or bearing thereagainst.

The interior structure of the housing-like base 28 is described with reference to FIG. 9 which corresponds essentially to a vertical cross-sectional view of the fixture depicted in FIGS. 1 and 2. As shown, the housing 28 is integrally formed with posts or struts 70 and 72 which are arranged in pairs and project upwardly of the floor 32 of the housing 28, interiorly thereof. In the example of the fixture 20 depicted, the strut pairs each include an inner strut 70 and and outer strut 72. Four such pairs of struts are employed in the specific embodiment of the invention illustrated. It is to these struts that other structural components of the fixture 20 may be fastened, as described more fully herebelow. To this end, the struts or posts 70 and 72 are formed with upwardly-opening, threaded bores or holes 80 and 82 to receive mating bolts, screws, or equivalent fasteners 86 and 88. Optionally, as indicated in FIG. 9, the outer surface 92 of the floor 32 of the housing 28 may carry integrally molded stub-like feet 98 constituting mounting surface standoffs.

Referring further to that embodiment of the invention (FIGS. 1–3 and 9), which uses the deep cast aluminum housing, and further to the lens base 60, the latter is fabricated of molded polycarbonate plastics material. As seen most clearly in FIG. 9, the lens base 60 includes a wall 56, a lower annular end 102 of which seats to mate within the upwardly opening annular groove 50 at the upper limit of the sidewall 34 of the housing 28. The sidewall 56 of the lens base 60 extends upwardly to define an upwardly and inwardly angled continuation or wall extension 100 terminating in an upwardly opening channel-like groove 104. The latter is delineated by an integrally-formed pair of upwardly-directed inner and outer parallel walls 108 and 110.

Integrally formed with and extending downwardly from the walls 108 and 110 of the lens base 60 are downwardly extending legs 116 terminating in inwardly-directed plate-like feet 120 constituting assemblies 124 for fastening the lens base 60 to the housing 28. The leg assemblies 124 are arranged arcuately around the lens base 60 at annular spacing corresponding to the arcuate spacing of the posts 82 of the housing 28 so that the feet 120 of the leg assemblies 124 overlie and bear upon the tops of respective struts or posts 82. The feet 120 of the securement assemblies 124 are formed with through bores 126 which are in registry with the holes 82 in the posts 72, and a screw 88 is used to secure the atructure. (FIG. 9).

Referring further to the lens base 60 of the invention, and more specifically to the upper structure which includes that area involving the upper spaced walls 108 and 110 which define the channel-like groove 104, the inner wall 108 is formed with a group of annularly-spaced through slots or keyways 130 which are used in securing a lens assembly 140 of the invention in place on the lens base 60, as described below.

Figure 4:
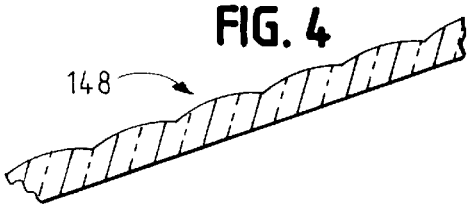
FIG. 4 is an enlarged, fragmentary, cross-sectional view taken substantially on the lines 4—4 of FIG. 1 and showing a detail of the flute prism used in generating a long, narrow throw or light distribution, in accordance with the present invention.
Figure 5:
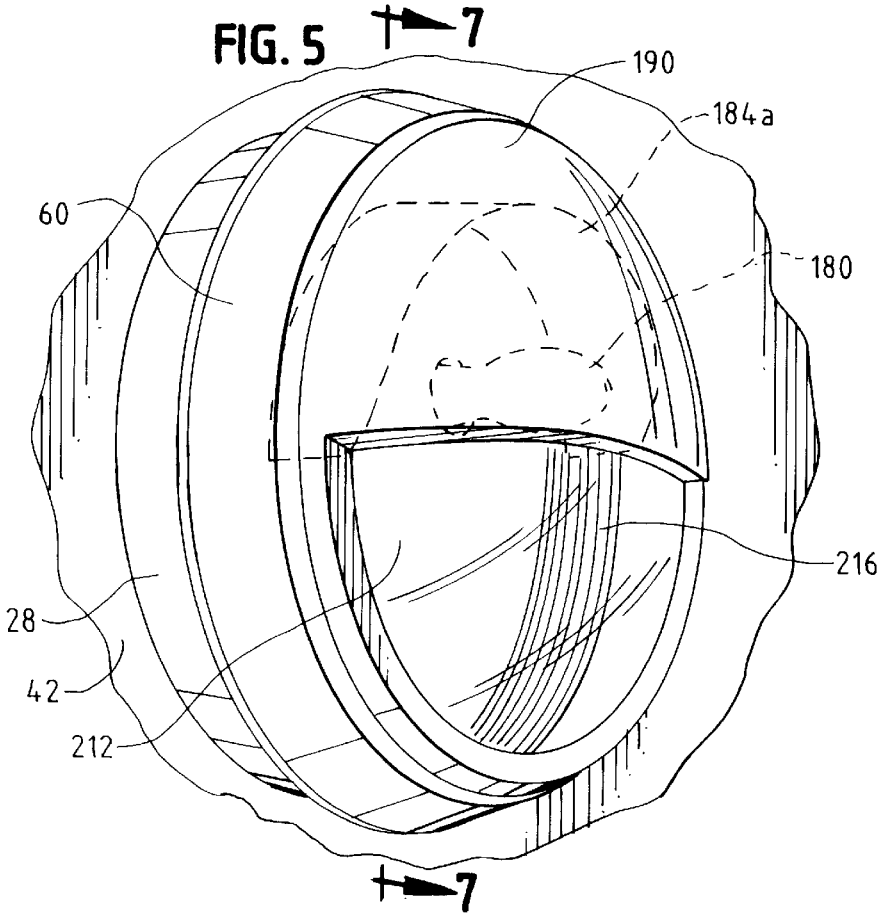
FIG. 5 is a perspective view showing a wall-mounted lighting fixture, in accordance with the present invention.
Figure 6:
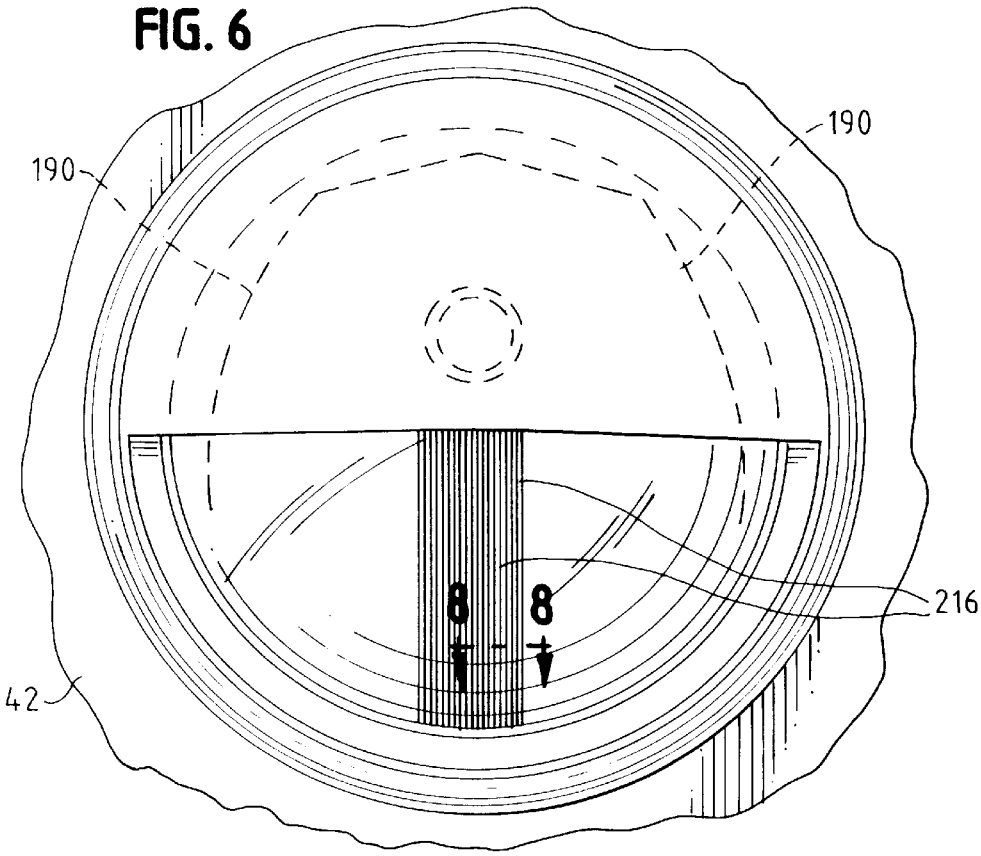
FIG. 6 is an elevational view of the wall-mounted fixture of FIG. 5 and showing a refractor for producing a "short-wide" light distribution pattern, in accordance with the invention.
Figure 7:
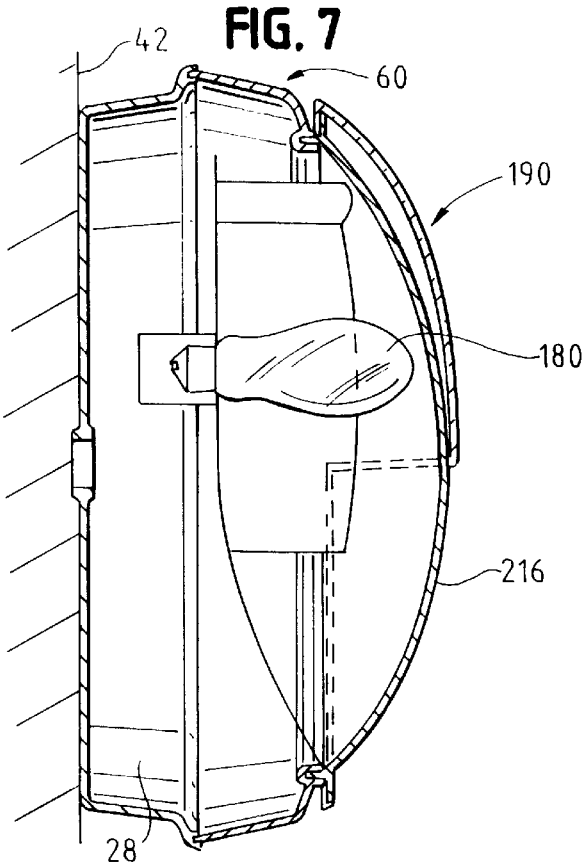
FIG. 7 is a cross-sectional view taken substantially on the lines 7—7 of FIG. 5, and depicting the arrangement of components in the interior of the lighting fixture.
Figure 8:
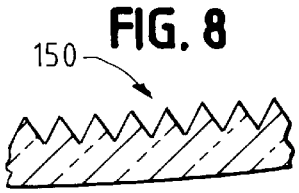
FIG. 8 is an enlarged, fragmentary, cross-sectional view taken substantially on the lines 8—8 of FIG. 6 and showing a detail of the refractory prism of the lens of the fixture, for generating a "short-wide" throw or light distriburion pattern, in accordance with the invention.

A third principal component of the embodiment of the invention, already identified, is the lens assembly 140 depicted in FIGS. 1–3 and 9, and also in FIG. 5. Each structure includes a lens 144. In the specific illustrative example of the lens illustrated, the structure of the basic lens 144, consists, per se, essentially of a rounded or vaulted principal surface 146 in which a refractory pattern or patterns 148 and 150, for example, those shown in FIGS. 1, 2, 4 and 6, which include those represented by FIGS. 4 and 8, is molded or impressed.

Figure 12:
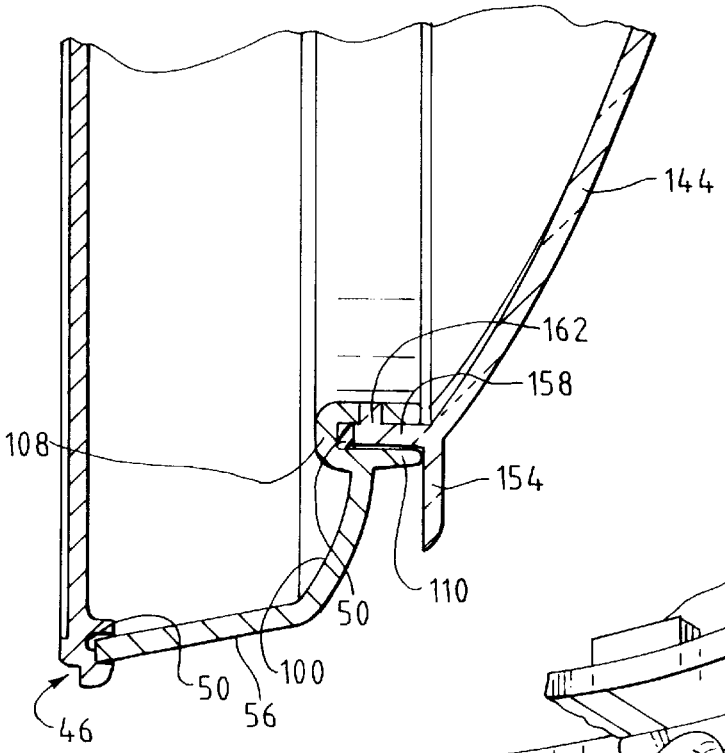
FIG. 12 is a fragmentary, cross-sectional view taken substantially on the lines 12—12 of FIG. 10 and showing a detail of the novel interior or internal lugs of the lens component in coupling interengagement within cooperating slots formed in the lens base of the fixture.
Figure 14:
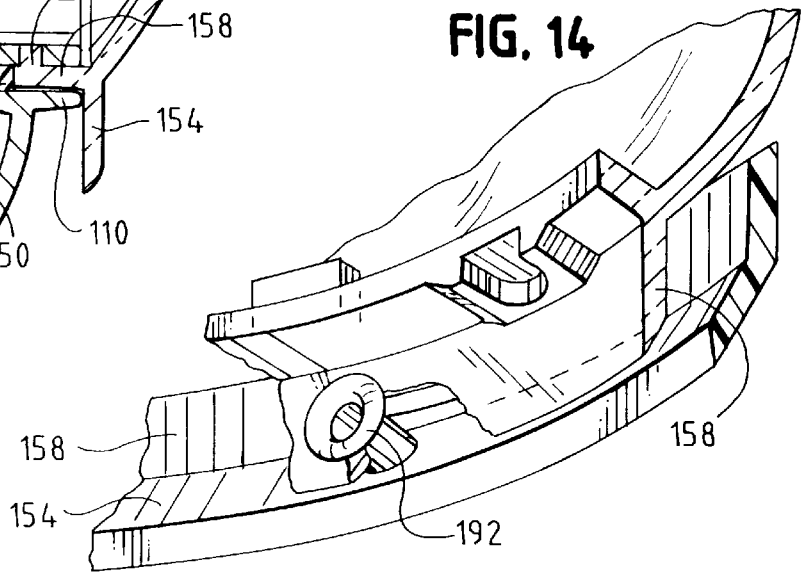
FIG. 14 is an enlarged, perspective detail of an embodiment of the invention showing a lens-locking lug in accordance with the invention, and showing a rivet-like heat stake of the type used to fasten the eyelid onto to overlie the lens of the fixture.

It is a very important feature of the present invention that there is provided an improved and novel structure by which the lens 144 is mounted on and positively secured to the supporting lens base 60. As shown in FIG. 9, and as further illustrated in fragmentary FIGS. 12 and 14, the lens 144 is formed at its radially outward periphery with a horizontally-projecting essentially flat band 154. Conveniently, the eyelid 190 is secured, to overlie the lens 144, by means of rivet-like heat stakes 192 (FIG. 14). As shown in FIG. 9, at a juncture of the vaulted surface of the lens proper 144 with the flat band 154, the lens assembly 140 is formed with a downwardly extending annular skirt or flange 158.

Integrally formed with, as a critical structural feature of the lens assembly 140, are a series of interior, radially inwardly directed, lugs or keys 162 formed on an inner side of the annular flange 158. The lugs 162 are spaced arcuately about the flange 158 in annular correspondence with the slots or keyways 130 formed in the inner upper annular wall 108 of the lens base 60 so that the lugs 162 and the lug-receiving slots 130 are in opposed registry. In order to attach the lens assembly 140 to the supporting lens base 60, one aligns the lugs 162 with the slots or keyways 130 of the lens base 60, and lowers the lugs 162 through an open upper section of the keyways 130. Finally, one twists or rotates the lens assembly 140 through a small arc so that the lugs 162 enter and engage within the relatively restricted sections at the base of the keyways 130. In a preferred embodiment of the invention the bottom channels in the keyways 130 are configured to define tapered constrictural zones so that a positive interference securement is established between the lugs 162 and the confining walls defining the lower slot portion 170 of the keyways 130 as the lugs 162 are advanced into the restricted openings defining the lower extremities of the keyways 130.

Referring again to the embodiment of the invention illustrated in FIGS. 1–3, and particularly to FIG. 1 in which a portion of the lens 144 has been cut away, it will be seen that the internal components of the fixture 20 include an illuminating lamp 180 and a parabolic reflector 184. Attention is now directed to additional novel features relating to the present invention. FIGS. 1–3 show the lens assembly 140 of the fixture 20 as including an opaque eyelid 190. The eyelid 190 is of a plastics composition and takes the form of a ring 198 integrally formed with a hemispherical section 196 which overlies half of the areal expanse of a full lens 144. The transparent, light-transmitting hemispherical section 200 of the lens carries a cast refractory design 202 which consist of an array of evenly spaced flute prisms 206 extending across the entire expanse of the refractory surface, with the flutes 206 being normal to a diameter 208 of the lens, as shown in FIG. 2. The refractory structure in the FIGS. 1–3 embodiment of the invention generate "long-narrow" patterns or throws of illuminating light beams.

In the embodiments of the invention illustrated in FIGS. 5–8, the pattern formed on the transparent refractory hemisphere 212 not blocked by the opaque eyelid 190 takes the form of a compressed narrow band of prisms consisting of Blondel flutes 216 providing a "'short-wide" pattern or throw of illuminating transmitted light. Each of the additional embodiments of the invention has its own parabolic reflector, for example, 184*a* in FIG. 5.

Figure 10:
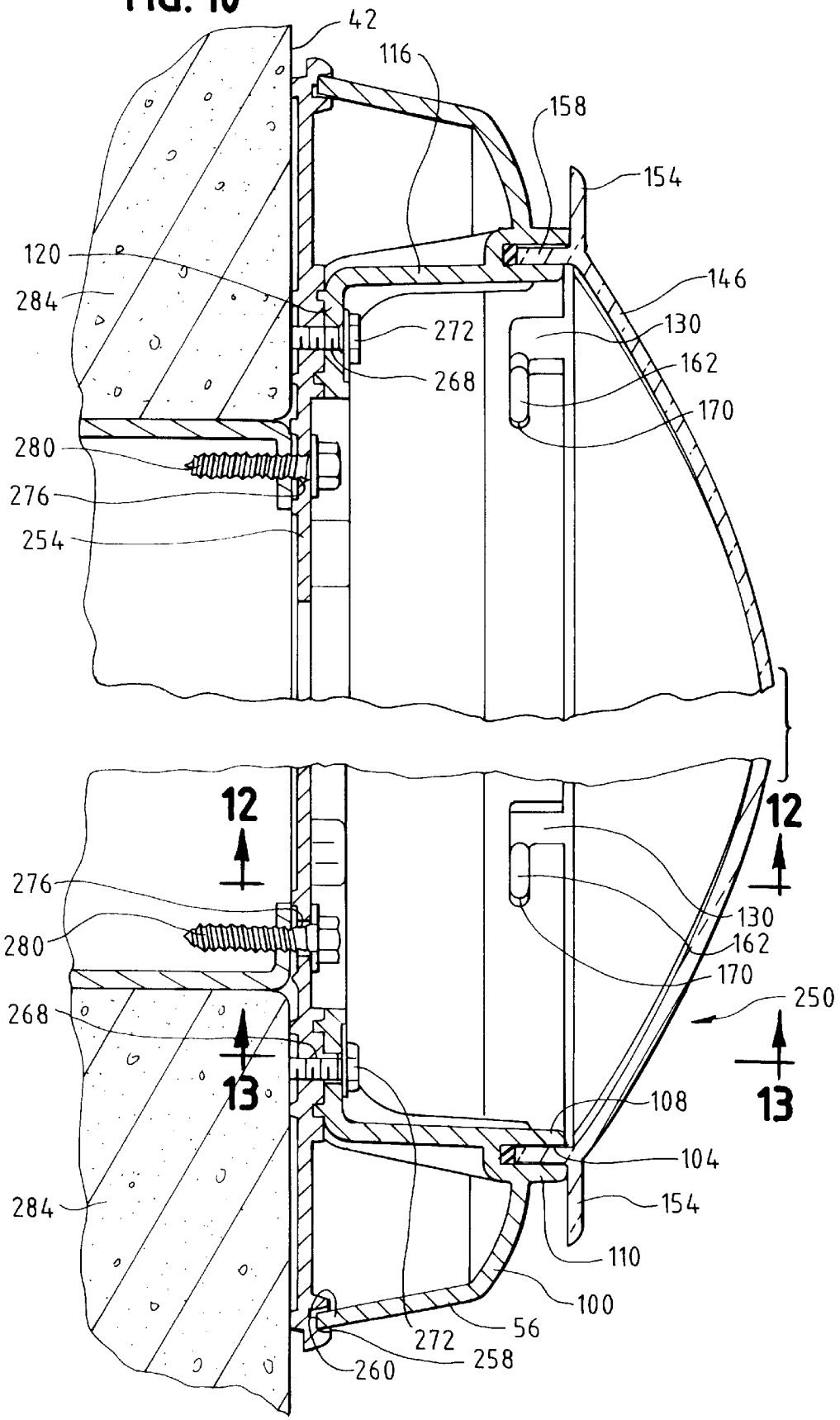
FIG. 10 is a vertical cross-sectional view of a second embodiment of the invention, in which the lens-carrying lens base is mounted on a plate which serves as the base of the fixture, secured to a supporting surface, and indicating schematically the lugs and cooperating slots by which the lens is secured to the lens base.

Referring now to FIG. 10, there is shown an embodiment of the invention consisting of a fixture 250 in which the deep metal casting 28 described with respect to the structure depicted in FIGS. 1–3 and FIG. 9 is not used as a base. Rather, in the embodiment of FIG. 10, the base employed takes the form of a die-cast aluminum plate 254. The same lens base 60, previously described, is used in the FIG. 10 embodiment as described hereinabove. As was the deep casting 28, the plate 254 is formed with a circumscribing annular upwardly-opening groove or channel 258 in which the downwardly-extending, circumambient lower edge 260 of the principal wall 56 of the lens base 60 is received. A gasket 264, seated in the channel 258, beneath the wall 56, ensures a fluid-impervious seal between the lens base 60 and the baseplate 254.

The baseplate 254 is formed with through threaded openings 268 located for registry with the openings or bores 126 formed in the feet 120 in the leg assemblies 124 depending from an upper zone of the lens base 60 to facilitate securement of the lens base 60 to the baseplate 254 by means of bolts or screws 272. Also, as shown in FIG. 10, the baseplate is preformed with additional through bores 276 through which screws or other fasteners 280 may be inserted to secure the baseplate 254 to a supporting substrate 284.

Figure 11:
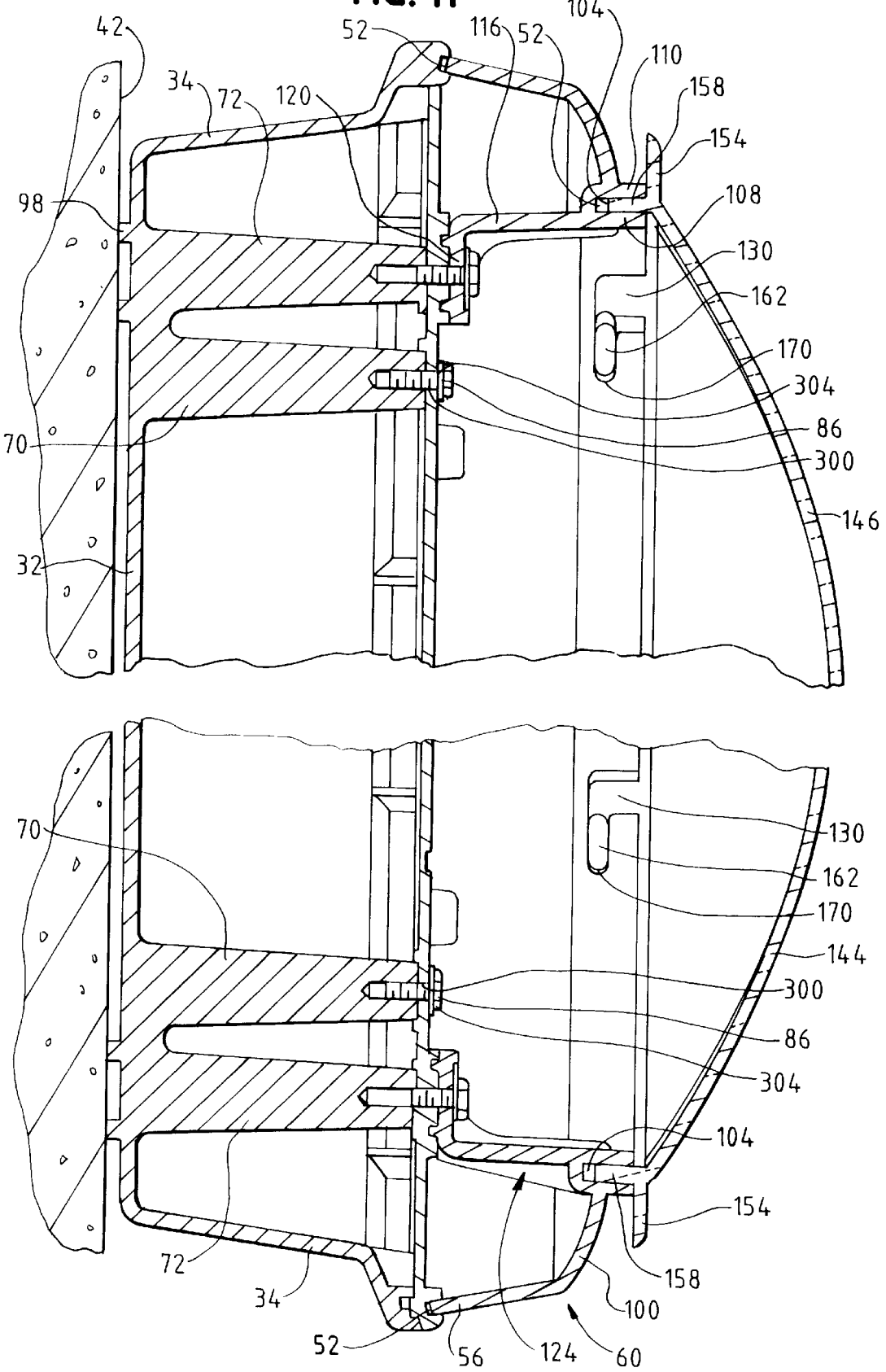
FIG. 11 is a vertical cross-sectional view of yet another embodiment of the invention, in which the base of the fixture includes, in combination, a metal plate surmounting a deep metal casting, and secured to integrally-formed interior piers or posts thereof.

Yet another embodiment of the invention is depicted in FIG. 11. As shown, the supporting base in the illustrated fixture consists of a combination of the earlier described deep metal casting or housing 28 and the die-cast aluminum plate 254 shown in the assembly of FIG. 10. The die-cast 'baseplate 254 is provided with through openings or bores 300 which are in registry with the ports 80 formed in the previously described struts or posts 70, and, conveniently, threaded screws or bolts 304 are inserted in the sets of registering, aligned openings 80 and 300 to effect a simple and positive securement of the baseplate 254 to the housing 28.

The lens base 60, which overlies the deep casting-secured baseplate 254, is secured at its leg assemblies 124 to the posts or struts 72 of the deep metal casting or housing 28, in the manner previously described.

Figure 13:
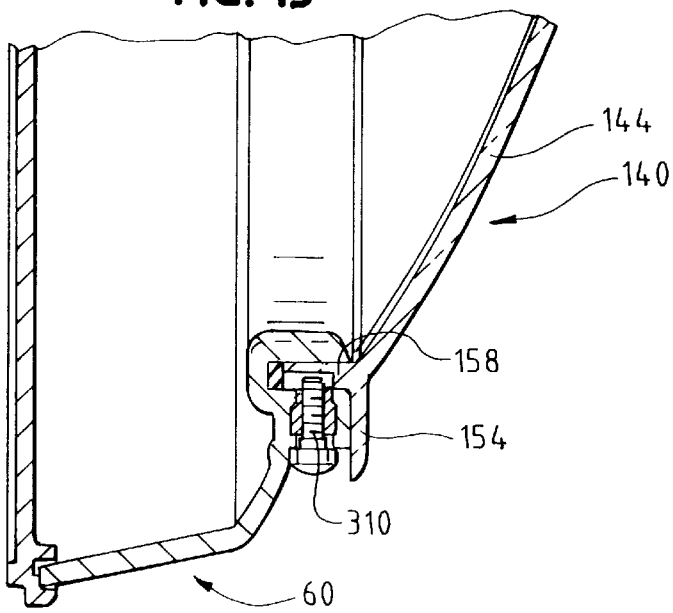
FIG. 13 is an enlarged fragmentary view taken substantially on the lines 13—13 of FIG. 10 and showing the use of a screw to lock the lens against separation from the lens base, in accordance with the present invention.

In a preferred embodiment of the invention there is provided a single, tamper-resistant screw 310 to deter the unlocking of the lens assembly 140 from the lens base 60 (FIG. 13).

What is claimed is:

1. A lighting fixture for surface mounting, said fixture including mechanical features and surface properties adapting said fixture and rendering said fixture safe and effective use in high abuse environments, said fixture further comprising base means including means for facilitating physically securing said fixture to a supporting structural surface bounding a defined spatial zone be illuminated;

a single, sole illuminating lamp in said fixture;

a lens base, fastening means for attaching said lens base to overlie said base means, lens means for controlling and distributing light developed in and emanating from said light fixture;

coupling means for securing said lens means to said lens base;

eyelid means disposed to overlie said lens means for providing lamp shielding for controlling light Output from said lighting fixture, and for controlling light distribution, and means for facilitating rotation of said eyelid means through about 180 degrees of arc with respect to said lens means of said lighting fixture.

2. A lighting fixture as set forth in claim 1 and further comprising means for facilitating rotation of said eyelid means through about 180 degrees of arc with respect to said lens means of said lighting fixture.

3. A lighting fixture as set forth in claim 1 wherein said lens means is formed with two distinct and separate reflector/refractor systems, including a first system for generating a long and narrow throw of light distribution, and a second system for generating a short and wide throw of light distribution.

4. A lighting fixture as set forth in claim 1 and wherein a second of said sectors of said lens means is formed with a tight band of refractors comprising sharp vertical prisms, said vertical prisms comprising means which, in conjunction with said parabolic reflector of said lighting fixture, constitute means for providing a short and wide throw of illuminating light beams.

5. A lighting fixture as set forth in claim 1 wherein said vertical prisms comprise evenly-spaced, pyramidically-shaped, 60 degree prisms.

6. A lighting fixture as set forth in claim 1 wherein said flute prisms comprise Blondel flutes of about 0.75 inch radius formed on a spherical surface of said lens means.

7. A lighting fixture as set forth in claim 6 wherein said Blondel flutes comprise means for obscuring lamp images and for providing equal brightness in a plurality of viewing angles.

8. A lighting fixture as set forth in claim 1 wherein said eyelid means comprises means for effectively halving said lens means along a diameter of said lens means.

9. A lighting fixture as set forth in claim 1 wherein said eyelid means comprises opaque, molded, structural means for providing optimum lamp shielding and for controlling light direction and distribution.

10. A lighting fixture as set forth in claim 1 and further comprising means for effectuating a push, turn, and lock-in-place actuation, for positioning and mating of said eyelid means with said lens base.

11. A lighting fixture as set forth in claim 1 wherein said base means comprises a deep, dish-like, metal casting.

12. A lighting fixture for surface mounting, said fixture including mechanical features and surface properties adapting said fixture and rendering said fixture safe and effective for use in high abuse environments, said fixture further comprising base means including means for facilitating physically securing said fixture to a supporting structural surface bounding a defined spatial zone to be illuminated;

a single, sole illuminating lamp in said fixture;

a lens base;

fastening means for attaching said lens base to overliesaid base means;

lens means for controlling and distributing light developed in and emanating from said lighting fixture;

coupling means for securing said lens means to said lens base;

eyelid means disposed to overlie said lens means for providing lamp shielding and for controlling light output from said lighting fixture, and for controlling light distribution;

said eyelid means constituting means for dividing said lens means along a diameter of said lens means into two distinct areal sectors; and a second of said sectors of said lens means being formed with a tight band of refractors comprising sharp vertical prisms, said vertical prisms comprising means which, in conjunction with said parabolic reflector of said lighting fixture, constitute means for providing a short and wide throw of illuminating light beams.

13. A lighting fixture as set forth in claim 12 wherein said vertical prisms comprise evenly-spaced, pyramidically-shaped, 60 degree prisms.

14. A lighting fixture as set forth in claim 13 wherein said lens means is formed with two distinct and separate reflector/refractor systems, including a first system for generating a long and narrow throw of light distribution, and a second system for generating a short and wide throw of light distribution.

15. A lighting fixture as set forth in claim 13 wherein said eyelid means comprises means for effectively halving said lens means along a diameter of said lens means.

16. A lighting fixture as set forth in claim 13 wherein said eyelid means comprises opaque, molded, structural means for providing optimum lamp shielding and for controlling light direction and distribution.

17. A lighting fixture as set forth in claim 12 wherein said lens means is formed with two distinct and separate reflector/refractor systems, including a first system for generating a long and a narrow throw of light distribution, and a second system for generating a short and wide throw of light distribution.

18. Alighting fixture as set forth in claim 12 wherein said eyelid means comprises means for effectively halving said lens means along a diameter of said lens means.

19. A lighting fixture as set forth in claim 12 wherein said eyelid means comprises opaque, molded, structural means for providing optimum lamp shielding and for controlling light direction and distribution.

20. A lighting fixture for surface mounting, said fixture including mechanical features and surface properties adapting said fixture and rendering said fixture safe and effective for use in high abuse environments; said fixture further comprising base means including means for facilitating physically securing said fixture to a supporting structural surface bounding a defined spatial zone to be illuminated;

a single, sole illuminating lamp in said fixture;

a lens base;

fastening means for attaching said lens base to overlie said base means;

lens means for controlling and distributing light developed in and emanating from said lighting fixture;

coupling means for securing said lens means to said lens base;

eyelid means disposed to overlie said lens means for providing lamp shielding and tor controlling light Output from said lighting fixture, and for controlling light distribution; and means for effectuating a push, turn, and lock-in-place actuation, for positioning and mating of said eyelid means with said lens base.

21. A lighting fixture as set forth in claim 20 wherein said lens means is formed with two distinct and separate reflector/refractpr systems, including a first system for generating a long and narrow throw of light distribution, and a second system for generating a short and wide throw of light distribution.

22. A lightimg system as set for th in claim 20 wherein said eyelid means comprises means for effectively halving said lens means along a diameter of said lens means.

23. A lighting fixture as set forth in claim 20 wherein said eyelid means comprises opaque, molded, structural means for providing optimum lamp shielding and for controlling light direction and distribution.

* * * * *